US009080303B2

(12) United States Patent
Freitag et al.

(10) Patent No.: US 9,080,303 B2
(45) Date of Patent: Jul. 14, 2015

(54) REINFORCED SOIL STRUCTURE

(75) Inventors: Nicholas Freitag, Orsay (FR); Jean-Claude Morizot, Paris (FR)

(73) Assignee: TERRE ARMEE INTERNATIONALE, Velizy Villacoublay (FR)

( * ) Notice: Subject to any disclaimer, the term of this patent is extended or adjusted under 35 U.S.C. 154(b) by 0 days.

(21) Appl. No.: 13/825,522

(22) PCT Filed: Sep. 26, 2011

(86) PCT No.: PCT/EP2011/066645

§ 371 (c)(1), (2), (4) Date: Mar. 21, 2013

(87) PCT Pub. No.: WO2012/038549

PCT Pub. Date: Mar. 29, 2012

(65) Prior Publication Data

US 2013/0202367 A1 Aug. 8, 2013

(30) Foreign Application Priority Data

Sep. 24, 2010 (EP) ..... 10306034

(51) Int. Cl.
*E02D 29/02* (2006.01)
*E02D 17/20* (2006.01)

(52) U.S. Cl.
CPC ..... *E02D 29/0233* (2013.01); *E02D 17/20* (2013.01); *E02D 29/0241* (2013.01)

(58) Field of Classification Search
CPC ..... E02D 29/0241; E02D 29/0225; E02D 29/025; E02D 29/0233
USPC ..... 405/262, 284, 285, 286, 287, 287.1, 405/302.4, 302.7; 52/432
See application file for complete search history.

(56) References Cited

U.S. PATENT DOCUMENTS

| | | | | |
|---|---|---|---|---|
| 4,343,571 | A | 8/1982 | Price et al. | |
| 6,224,295 | B1 | 5/2001 | Price et al. | |
| 6,238,144 | B1 * | 5/2001 | Babcock | 405/284 |
| 2001/0014255 | A1 | 8/2001 | Orsat | |
| 2008/0292413 | A1 * | 11/2008 | Mateer | 405/284 |
| 2012/0076592 | A1 * | 3/2012 | Freitag et al. | 405/262 |

FOREIGN PATENT DOCUMENTS

| | | |
|---|---|---|
| EP | 1114896 A1 | 7/2001 |
| FR | 2 860 811 | 4/2005 |

(Continued)

*Primary Examiner* — Tara M. Pinnock
*Assistant Examiner* — Carib Oquendo
(74) *Attorney, Agent, or Firm* — McKenna Long & Aldridge LLP

(57) ABSTRACT

A reinforced soil structure comprising:—a fill (1);—a facing (3) placed along a front face of the structure;—at least one main reinforcement member (2, 9, 26) connected to the facing and extending through a first reinforced zone (Z1) of the fill situated behind said front face; and—at least one secondary reinforcement member (6) disconnected from to the facing and extending in a second reinforced zone (Z2) of the fill which has, with said first reinforced zone (Z1), a common part (Z'), wherein the secondary reinforcement member (6) extends into the fill (1) up to a distance substantially shorter than the main reinforcement member (2, 9, 26), with respect to the front face and wherein the stiffness of the secondary reinforcement member (6) is greater or equal to the stiffness of the main reinforcement member (2, 9, 26).

13 Claims, 5 Drawing Sheets

(56) References Cited

FOREIGN PATENT DOCUMENTS

| | | |
|---|---|---|
| FR | 2 896 520 | 7/2007 |
| FR | 2 922 234 | 4/2009 |
| GB | 2 255 581 | 11/1992 |

* cited by examiner

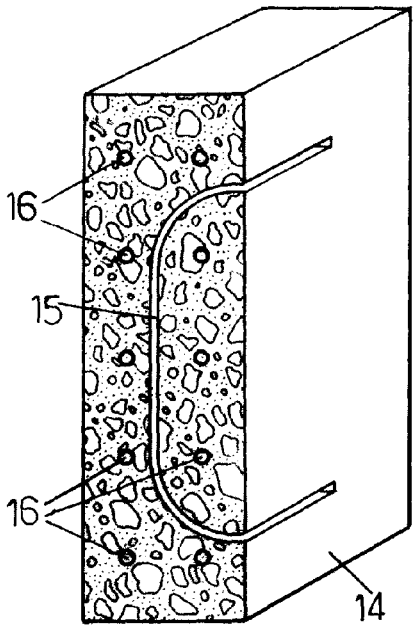
FIG.3
FIG.4
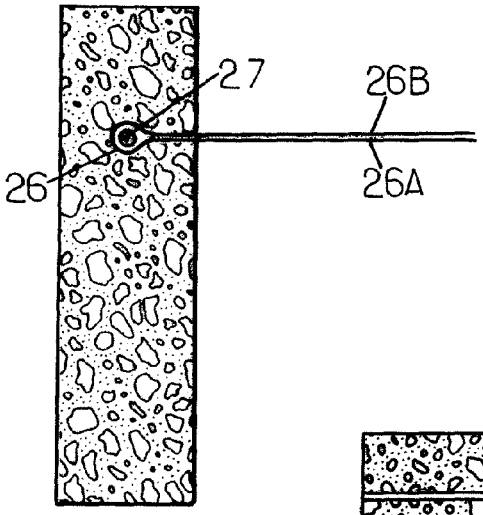
FIG.5
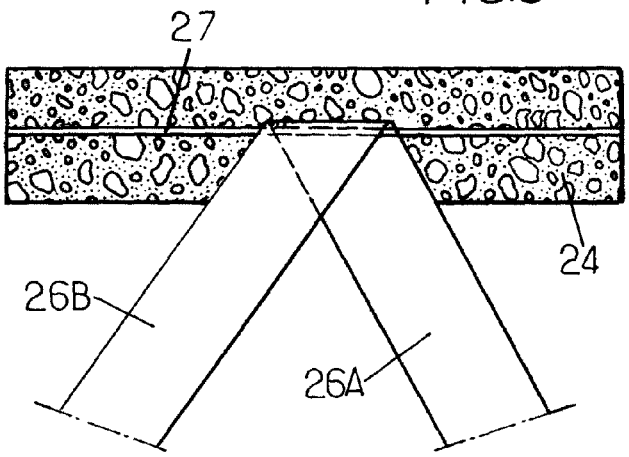

REINFORCED SOIL STRUCTURE

This Application is a 35 U.S.C. §371 National Stage Entry of International Application No. PCT/EP2011/066645, filed Sep. 26, 2011 and claims the benefit of European Application 10306034.9, filed Sep. 24, 2010, all of which are incorporated by reference in their entirety herein.

FIELD OF THE INVENTION

The present invention relates to the construction of reinforced soil structures. This building technique is commonly used to produce structures such as retaining walls, bridge abutments, etc.

BACKGROUND OF THE INVENTION

A reinforced soil structure combines a compacted fill, a facing and reinforcements usually connected to the facing.

Various types of reinforcement can be used: metal (for example galvanized steel), synthetic (for example based on polyester fibers), etc. They are placed in the earth with a density that is dependent on the stresses that might be exerted on the structure, the thrust of the soil being reacted by the friction between the earth and the reinforcements.

The facing is usually made from prefabricated concrete elements, in the form of panels or blocks, juxtaposed to cover the front face of the structure.

There may be horizontal steps on this front face between various levels of the facing, when the structure incorporates one or more terraces. In certain structures, the facing may be built in situ by pouring concrete or a special cement.

The reinforcements placed in the fill are secured to the facing by mechanical connecting members that may take various forms. Once the structure is completed, the reinforcements distributed through the fill transmit high loads, that may range up to several tons. Their connection to the facing needs therefore to be robust in order to maintain the cohesion of the whole.

These connections between the reinforcements entail a risk that the maximum load they can withstand may be exceeded if the soil undergoes differential settlement or in the event of an earthquake. Furthermore, the connecting members exhibit risks of degradation. They are often sensitive to corrosion due to moisture or chemical agents present in or which have infiltrated into the fill. This disadvantage often prevents the use of metal connecting members. The connecting members are sometimes based on resins or composite materials so that they degrade less readily. However, their cost is then higher, and it is difficult to give them good mechanical properties without resorting to metal parts. For example, if the reinforcements are in the form of flexible strips and attach by forming a loop behind a bar secured to the facing (U.S. Pat. No. 4,343,571, EP-A-1 114 896), such bar undergoes bending stresses, which is not ideal in the case of synthetic materials.

By construction, the prefabricated facing elements have a determined number of locations for connection to the reinforcements of the fill. This results in constraints on the overall design of the structure, particularly in terms of the density with which the reinforcements can be placed. For example, if the prefabricated elements each offer four attachment points, the designer will need to envisage connecting the reinforcements there that many times, or possibly a lower number of times, the number always being a whole number. If structural engineering considerations require, for example, 2.5 pairs of main reinforcements per prefabricated element, it is necessary to provide a substantial surplus of reinforcements, which has an significant impact on the cost. These considerations complicate the design of the structure, since the optimization generally requires reinforcement densities that can vary from one point in the fill to another.

OBJECTS AND SUMMARY OF THE DISCLOSURE

An object of the present invention is to propose a novel method of connection between the facing and the reinforcements placed in the fill which makes it possible to reduce the impact of the above-mentioned problems.

The invention thus proposes a reinforced soil structure comprising a fill, a facing placed along a front face of the structure, at least one main reinforcement member connected to the facing and extending through a first reinforced zone of the fill situated behind said front face, and at least one secondary reinforcement member disconnected from to the facing and extending in a second reinforced zone of the fill which has, with said first reinforced zone, a common part, wherein the secondary reinforcement member extends into the fill up to a distance substantially shorter than the main reinforcement member, with respect to the front face and wherein the stiffness of the secondary reinforcement member is greater or equal to the stiffness of the main reinforcement member.

This reinforced soil structure has significant advantages.

In particular, the configuration of the main reinforcement member and the secondary reinforcement member is such that the loads are transmitted between the main reinforcement member and the secondary reinforcement member by the material of the fill. Thus, the structure may have good integrity in the presence of small soil movement.

Furthermore, the stiffness of the structure is increased in the second reinforcement zone (Z2) thus reducing the tension applied to the connection of the main reinforcement member to the facing.

Advantageously, the load that the structure may support can be increase without requiring increasing the number of the main reinforcement members connected to the facing, thus, affording an important economic gain.

According to further embodiments of the invention, the reinforced soil structure according to the invention may comprise the following features alone or in combination:

- the main reinforcement member is selected among the following list consisting of: synthetic strip, metal strip, metal bar, strip shaped metal grid, sheet shaped metal grid, ladder shaped metal grating, synthetic strip, sheet shaped synthetic grid, ladder shaped synthetic grid, geotextile layer, geocell;
- the secondary reinforcement member is selected among the following list consisting of: synthetic strip, metal strip, metal bar, sheet shaped metal grid, ladder shaped metal grid, synthetic strip, sheet shaped synthetic grid, ladder shaped synthetic grid, geocell, geotextile layer;
- the facing comprises prefabricated elements in which the main reinforcement member is partly embedded;
- the prefabricated elements are made of concrete and the main reinforcement member comprises flexible synthetic reinforcement member having at least one part casted into the concrete of one of the prefabricated elements;
- the casted part of the flexible synthetic reinforcement member follows a loop within said one of the prefabricated elements, so that said flexible synthetic reinforcement member has two sections projecting into the first reinforced zone of the fill;

the loop is arranged in said one of the prefabricated elements so that the two sections of said flexible synthetic reinforcement member emerge from the facing into the fill at vertically offset positions;

the loop is arranged in said one of the prefabricated elements so that the two sections of said flexible synthetic reinforcement member emerge at different angles from the facing into the fill in substantially the same horizontal plane;

the facing comprises wire mesh panels to which a soil reinforcement is connected as main reinforcement member; and the secondary reinforcement member is arranged along a zigzag path in the second reinforced zone.

The invention may be applied to the repair of an existing structure, but its preferred application is that of the production of a new structure.

The invention further relates to a method for building a reinforced soil structure, comprising the steps of:

positioning a facing along a front face of the structure delimiting a volume to be filled;

placing at least one main reinforcement member in a first reinforced zone of said volume, wherein the main reinforcement member is connected to the facing and extend through the first reinforced zone;

placing at least one secondary reinforcement member not permanently connected to the facing in a second reinforced zone of said volume, said first and second zones having a part in common, wherein the secondary reinforcement member is installed up to a distance substantially shorter than the main reinforcement member with respect to the front face, and wherein the stiffness of the secondary reinforcement member is greater or equal to the stiffness of the main reinforcement member;

introducing fill material into said volume and compacting the fill material.

According to further embodiments of the invention, the method according to the invention may comprise the following features alone or in combination:

comprising the step of determining independently an optimal configuration and density of a plurality of main reinforcement members in said first reinforced zone and an optimal configuration and density of a plurality of secondary members in said second reinforced zone, and comprising the step of connecting at least some of the secondary reinforcement strips to the facing by means of temporary attachments designed to break in the step of introducing and compacting the fill material.

BRIEF DESCRIPTION OF THE DRAWINGS

Non limiting embodiments of the invention will now be described with reference to the accompanying drawing wherein:

FIG. 3 is a schematic perspective view of a facing element usable in an embodiment of the invention.

FIGS. 4 and 5 are schematic elevation and top views of a facing element usable in another embodiment of the invention.

MORE DETAILED DESCRIPTION

Figure 1:
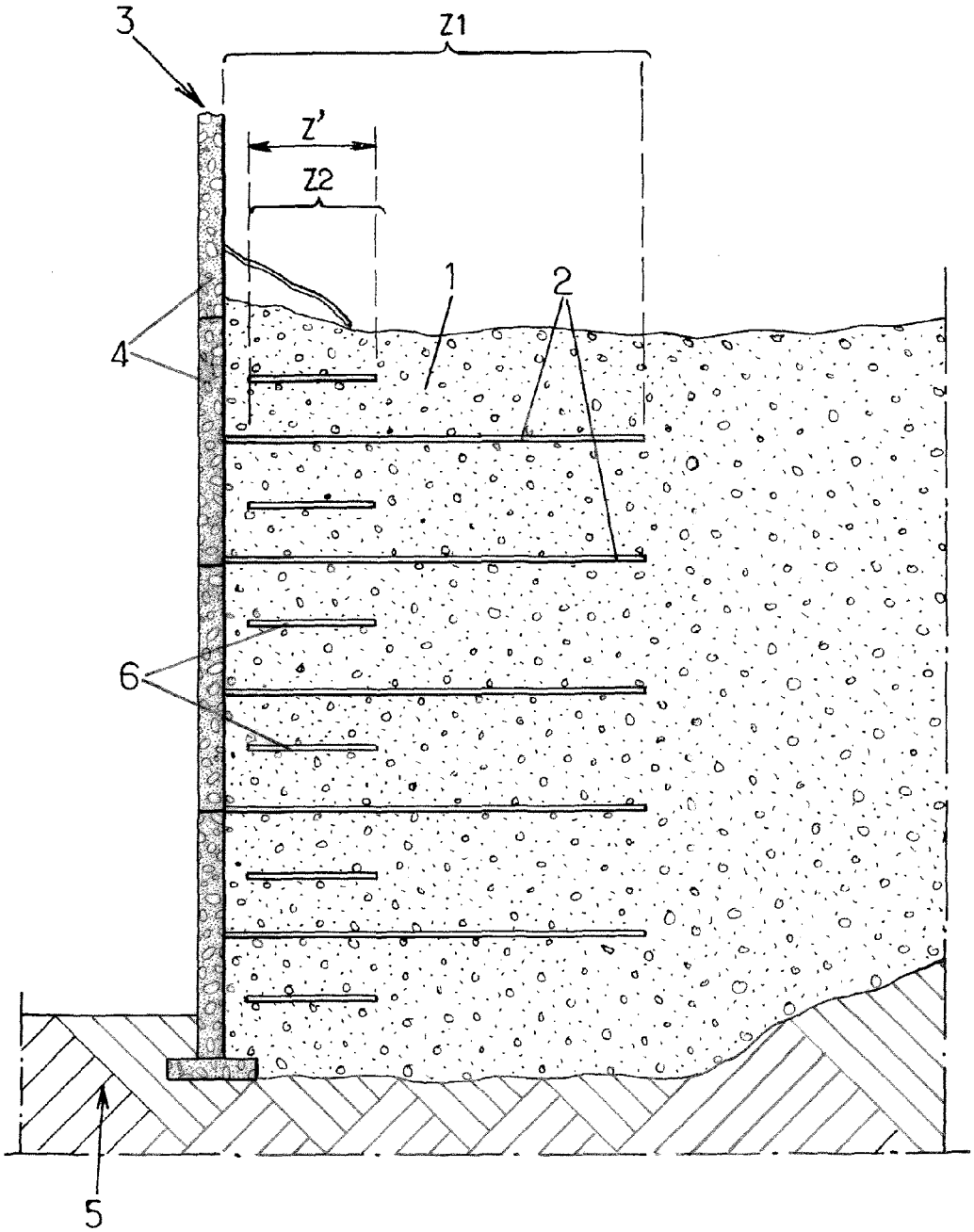
FIG. 1 is a schematic view in lateral section of a reinforced soil structure according to the invention, while it is being built.

According to an embodiment of the invention the reinforced soil structure may comprise a plurality of main and secondary reinforcement members. In the sense of the invention when the reinforced soil structure comprises a plurality of main and secondary reinforcement members the "stiffness of the main and secondary reinforcement members" is to be understood as the stiffness of the main and secondary reinforcement members per unit area of the facing. Thus according to such embodiment the feature "the stiffness of the secondary reinforcement member is greater or equal to the stiffness of the main reinforcement member" is to be understood as $k2 \times n2$ is greater than or equal to $k1 \times n1$, with k1 and k2 respectively the individual stiffness of the main and secondary reinforcement members and n1 and n2 respectively the density of the main and secondary reinforcement members per unit area of the facing.

The figures illustrate the application of the invention to the building of a reinforced soil retaining wall. A compacted fill 1, in which main reinforcement members 2 are distributed, is delimited on the front side of the structure by a facing 3 formed by juxtaposing prefabricated elements 4, in the form of panels in the embodiment illustrated in FIGS. 1 and 2, and on the rear side by the soil 5 against which the retaining wall is erected.

FIG. 1 schematically shows the zone Z1 of the fill reinforced with the main reinforcement members 2.

To ensure the cohesion of the retaining wall, the main reinforcement members 2 are connected to the facing elements 4, and extend over a certain distance within the fill 1.

Secondary reinforcement members 6 are not positively connected to the facing 3, which dispenses with the need to attach them to specific connectors. These secondary reinforcements 6 extend into the fill 1 up to a distance substantially shorter than the main reinforcement member 2, with respect to the front face.

According to the invention the stiffness of the secondary reinforcement members 6 is greater or equal to the stiffness of the main reinforcement member 2.

Furthermore, these secondary reinforcements 6 contribute to reinforcing the earth in a zone Z2.

According to an embodiment of the invention the secondary reinforcement members all have substantially the same length and are places at substantially the same distance from the facing.

According to an embodiment of the invention, the structure may comprise at least two groups of secondary reinforcement members. The secondary reinforcement members of each group have substantially the same length and are places at substantially the same distance from the facing. The secondary reinforcement members of the first group are place at a distance from the facing different than the secondary reinforcement members of the second group.

The cohesion of the structure results from the fact that the reinforced zones Z1 and Z2 overlap in a common part Z'. In this common part Z', the material of the fill 1 has good strength because it is reinforced by both the reinforcement members 2 and 6.

It is thus able to withstand the shear stresses exerted as a result of the tensile loads experienced by the reinforcements. This part Z' must naturally be thick enough to hold the facing 3 properly. In practice, a thickness of one to a few meters will generally suffice. By contrast, the main reinforcement members 2 may extend far more deeply into the fill 1, as shown by FIG. 1.

The simple addition of secondary reinforcement members 6 into the filling thus allows to reinforce the soil structure in the common part (Z') of the second reinforced zone (Z2) and the first reinforced zone (Z1).

It is preferable to avoid contacts between the main reinforcement members 2 and the secondary reinforcement members 6 in the common part Z'. This is because no reliance is placed on the friction forces between reinforcements for reacting the tensile loads given that it is difficult to achieve full control over these friction forces. By contrast, in the reinforced-earth technique, better control is had over the interfaces between reinforcements and fill, which means that the strength properties of the reinforced fill stressed in shear can be relied upon.

In the example depicted, the main reinforcement members 2 may be synthetic fiber-based strips. They may be connected to the facing 3 in various ways. They may be attached to the facing using conventional connectors, for example of the kind described in EP-A-1 114 896.

In a preferred embodiment, these main reinforcement members 2 are incorporated at the time of manufacture of the facing elements 4. In the frequent scenario where the elements 4 are prefabricated in concrete, part of the main reinforcement members 2 may be embedded in the cast concrete of an element 4. This cast part may in particular form one or more loops around steel bars of the reinforced concrete of the elements 4, thus firmly securing them to the facing.

Figure 2:
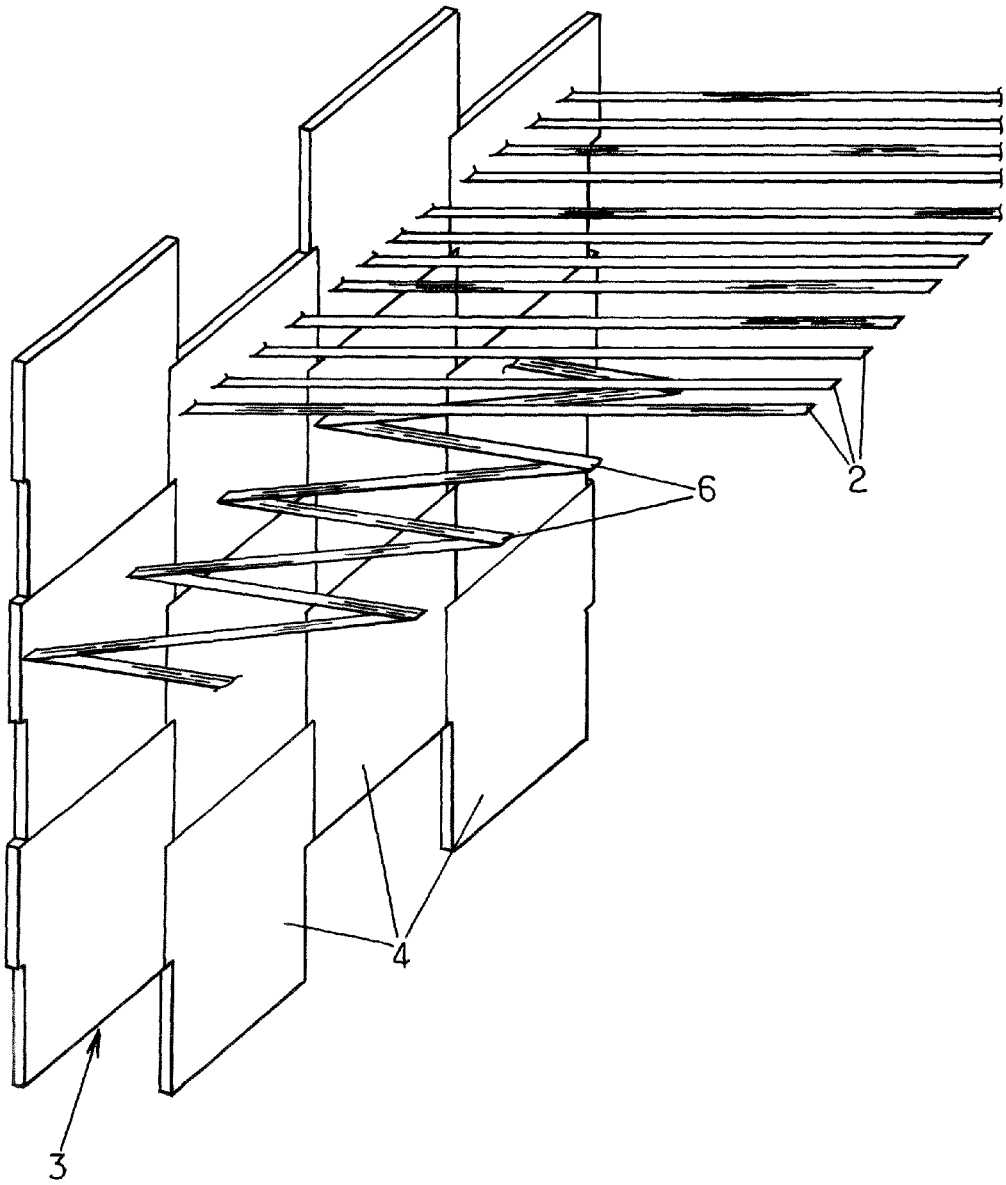
FIG. 2 is a perspective part view of this structure.

In the exemplary structure configuration illustrated by FIGS. 1 and 2, the main reinforcement members 2 and the secondary reinforcement members 6 are arranged in horizontal planes that are superposed in alternation over the height of the structure. Just two adjacent planes are shown in FIG. 2 in order to make it easier to read.

The secondary reinforcement members 6 may be strips of fiber-based synthetic reinforcing material following zigzag paths in horizontal planes behind the facing 3. These may in particular be the reinforcement strips marketed under the trade name "Freyssissol". Such strip advantageously has a width of at most 20 cm.

These secondary reinforcement members 6 may be laid in a zigzag formation between two lines at which they are folded back. The distance between these two lines is dependent on the volume of the reinforced zone Z1. The pitch of the zigzag pattern depends on the reinforcement density required by the structural engineering calculations.

Still in the example of FIG. 2, main reinforcements members 2 form a comb-like pattern in each horizontal plane in which they lie, the reinforcement strip forming a loop inside a facing element 4 between two adjacent teeth of the comb.

In order to build the structure depicted in FIGS. 1 and 2, the procedure may be as follows:

a) placing some of the facing elements 4 so as to be able thereafter to introduce fill material over a certain depth. In a known way, the erection and positioning of the facing elements may be made easier by assembly members placed between them;

b) installing a secondary reinforcement member 6 on the fill already present, laying it in a zigzag pattern as indicated in FIG. 2. Slight tension is exerted between the two loop-back lines of the secondary reinforcement member 6, for example using rods arranged along these lines and about which the strip is bent at each loop-back point;

c) introducing fill material over the secondary reinforcement member 6 which has just been installed, up to the next level of the main reinforcement members 2 on the rear side of the facing elements 4. This fill material is compacted as it is introduced;

d) placing on the fill the main reinforcement members 2 situated at said level, exerting slight tension thereon;

e) introducing fill material over this level and progressively compacting it until the next specified level for the placement of secondary reinforcement members 6 is reached;

f) repeating steps a) to e) until the upper level of the fill is reached.

It should be noted that numerous alternatives may be applied to the structure described hereinabove and to its method of production.

First, the main reinforcement members 2 may adopt very diverse forms, as is done in the reinforced soil technique (synthetic strip, metal bar, metal or synthetic grating in the form of a strip, a layer, a ladder, etc), woven or non-woven geotextile layer, etc. with the proviso that the stiffness of the secondary reinforcement member be greater or equal to the stiffness of the main reinforcement member.

Likewise, all kinds of facings may be used: prefabricated elements in the form of panels, blocks, etc, metal gratings, planters, etc. Furthermore, it is perfectly conceivable to build the facing 3 by casting it in situ using concrete or special cements, taking care to connect the secondary elements 6 therein.

The three-dimensional configurations adopted for the main reinforcement strips 2 and the secondary elements 6 within the fill 1 may also be very diverse. It is possible to find main reinforcements 2 and secondary elements 6 in the same horizontal plane (preferably avoiding contact with one another). It is also possible to have, in the common part Z', a varying ratio between the density of the main reinforcements 2 and that of the secondary members 6.

In the embodiment illustrated in FIG. 3, the facing element 14 is equipped with a reinforcement strip which follows a C-shaped path 15 when seen in a vertical section. The strip (not shown to display the shape of the path) is embedded in the concrete as it is poured into the manufacturing mould. It preferably passes around one or more metallic rods 16 used to reinforce the concrete element. The ends of the C-shaped path 15, at the level at the rear side of the facing element, guide the projecting sections of the strip in horizontal directions. Such strip sections provide a pair of main reinforcement members which emerge from the facing element 14 into the fill 1 at vertically offset positions. This arrangement takes advantage of the soil/plastic friction on both sides of each strip section, thus optimizing the use of the reinforcement material in zone Z1.

In the alternative embodiment illustrated in FIGS. 4 and 5, the main reinforcement member 26 forms a loop around a metallic reinforcement rod 27 of the concrete facing element 24. Its two projecting sections 26A, 26B emerge on the rear side of the facing element 24 in substantially the same horizontal plane. But in that plane (FIG. 5), their angles with respect of the rear surface of the element are different. The two strip sections 26A, 26B are laid at the same time on a level of the fill by keeping the angle between them. This oblique layout also takes full advantage of the soil/plastic friction on both sides of each strip section.

One of the significant advantages of the proposed structure is that it makes it possible to adopt very varied configurations and placement densities for the main reinforcement members 2, 9, 26 and the secondary members 6 because the transmission of loads by the fill material situated between them eliminates most of the constructional constraints associated with the method of connection between the main reinforcements and the facing. It will thus be possible to find, within one and the same structure, regions where the relative densities of main reinforcement members 26 and/or of secondary reinforcement members 6 vary significantly, while they are optimized individually.

An important advantage of the use of disconnected strips as the secondary reinforcement members 6 is that it provides a very large capacity to adjust the density of the secondary reinforcements: it is possible to vary as desired not only the vertical spacing of the reinforcement layers and their depths behind the facing, but also their density in a horizontal plane (e. g. by varying the pitch of the zigzag paths).

Such adjustment is not constrained by the predefined spacing of connectors behind the facing panels. A full 3D optimization of the amount of reinforcement is virtually achieved, which provides a very significant advantage in terms of cost of the reinforced soil structure. In addition, strip-shaped main reinforcements ensure a good control of the friction properties at the soil/reinforcement interface.

Figure 6:
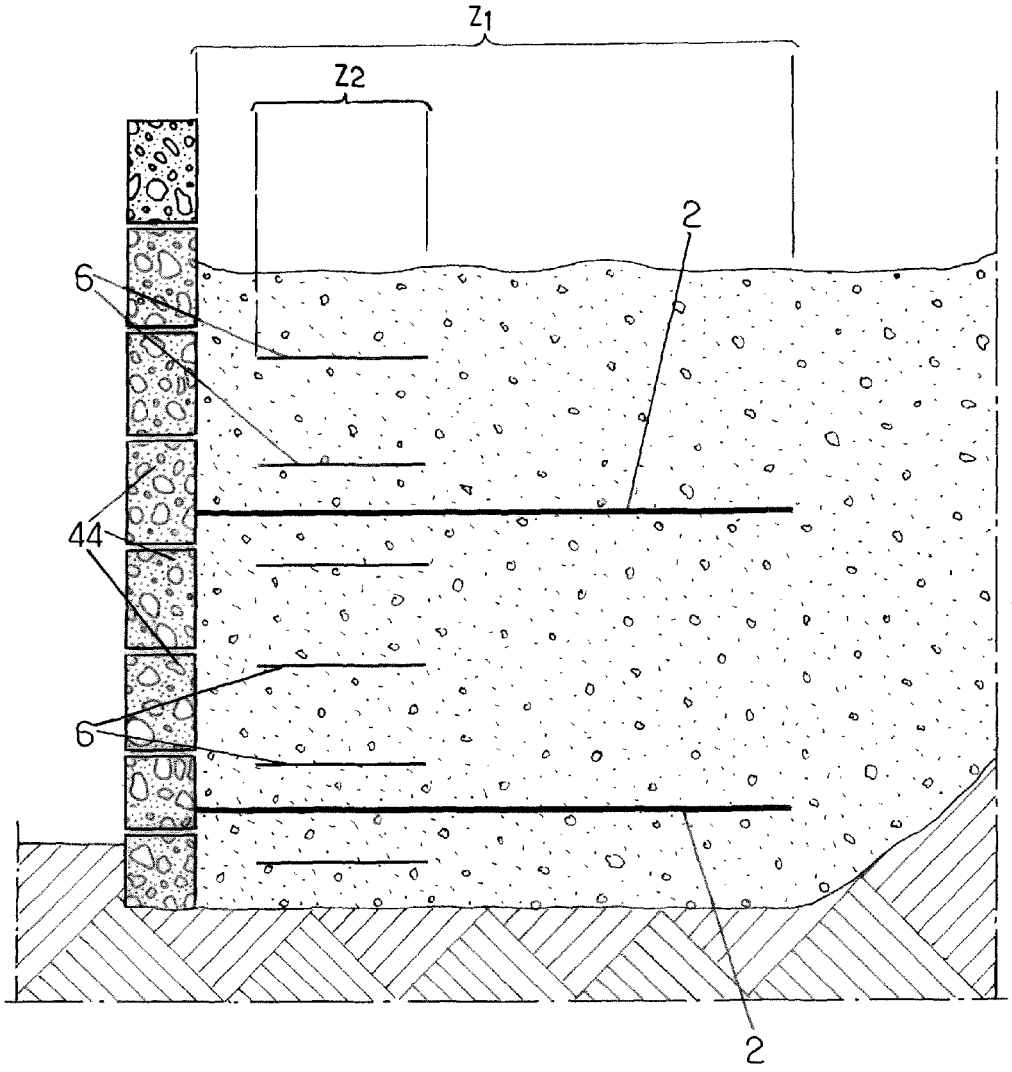
FIG. 6 is a schematic elevation view of another embodiment of a structure according to the invention.
Figure 7:
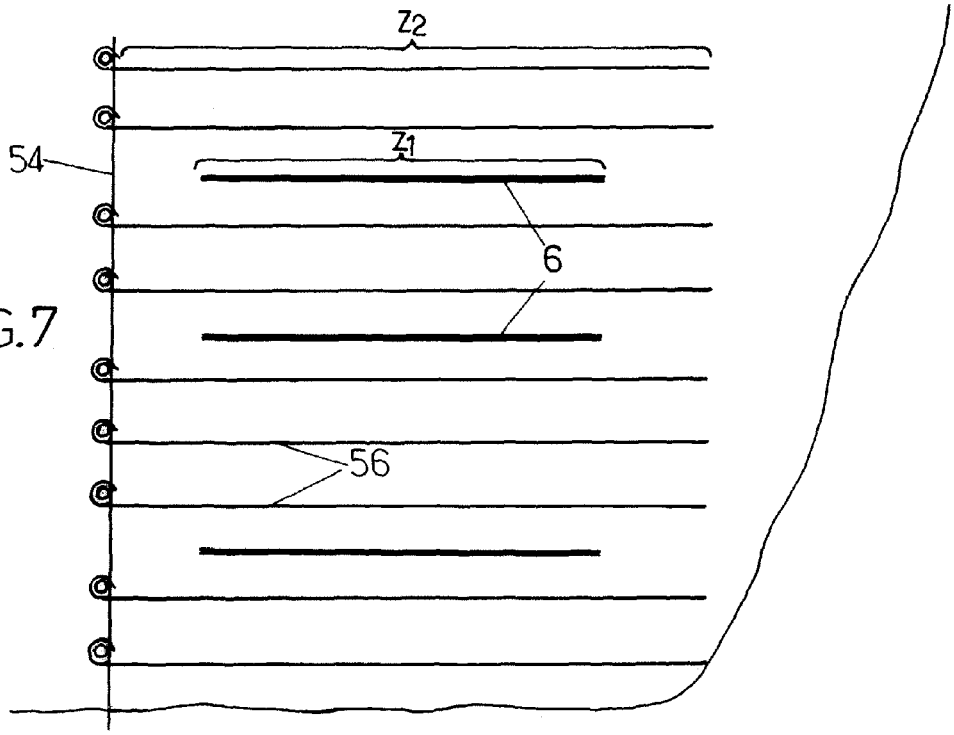
FIGS. 7 and 8 are schematic elevation and top views of yet another embodiment of a structure according to the invention.

In the embodiment shown in FIG. 6, the facing is made of blocks 44 of relatively small dimensions. These blocks are individually connected to the stabilized soil structure by means of main reinforcement members 2. Such arrangement ensures the individual stability of the blocks, and avoids offsets between adjacent blocks without requiring strong positive connections between the blocks. As shown in the figure, the density of the secondary reinforcement member 6 in zone Z1 may be lower than that of the main reinforcement members 2 in zone Z2.

Since, in this application, the reinforcement density in zone Z2 is set by the dimensions of the blocks 44, it is seen that the invention enables to optimize the amount of secondary reinforcement members to be used, which is an important economic advantage.

Figure 8:
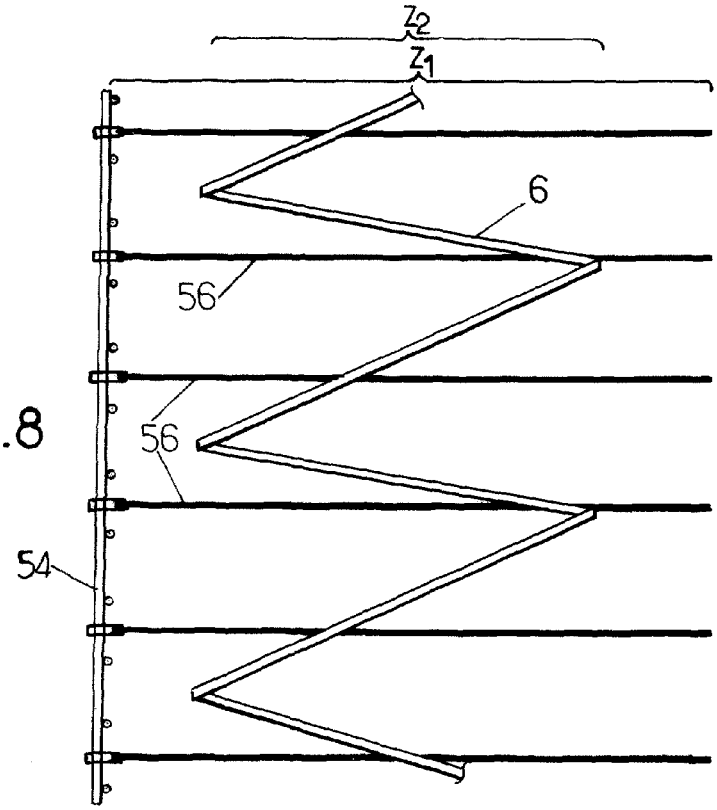

The invention is also interesting in reinforced soil structures whose facing is made of deformable panels, as illustrated in FIGS. 8 and 9. Such panels 54 may consist of a mesh of welded wires to which soil reinforcements 56 are connected, directly or via intermediate devices. Usually, the deformation of such wire mesh facing is limited by increasing the number of connection points and reinforcements. Again, the requirement to consolidate the facing leads to a higher expenditure for the reinforcements to be used. This problem is circumvented by the present invention since it permits to design the reinforcement of zone Z2 by means of the secondary reinforcement members 6 independently of that of the facing connection zone Z1 by means of the soil reinforcements 56 used as main reinforcement members.

When a secondary reinforcement member 6 is being placed on a level of the fill (step b above), it is possible to connect this reinforcement strip 2 to the facing by means of temporary attachments intended to break as the structure is gradually loaded with the overlying fill levels. Such temporary attachments, which are optional, make correct positioning of the main reinforcements easier, but are not relied upon to transmit load at the facing/fill interface once the structure is completed.

The invention has been described above with the aid of an embodiment without limitation of the general inventive concept.

What is claimed is:

1. A reinforced soil structure comprising:

a fill;

a facing placed along a front face of the structure;

at least one main reinforcement member connected to the facing and extending through a first reinforced zone of the fill situated behind said front face; and at least one secondary reinforcement member disconnected from the facing and extending in a second reinforced zone of the fill which has, with said first reinforced zone, a common part, wherein the at least one secondary reinforcement member extends into the fill up to a distance substantially shorter than the at least one main reinforcement member, with respect to the front face and wherein the stiffness of the at least one secondary reinforcement member is greater than the stiffness of the at least one main reinforcement member, and wherein contact is avoided between the at least one main reinforcement member and the at least one secondary reinforcement member in the common part.

2. The structure according to claim 1, wherein the at least one main reinforcement member comprises at least one of: synthetic strip, metal strip, metal bar, strip shaped metal grid, sheet shaped metal grid, ladder shaped metal grating, synthetic strip, sheet shaped synthetic grid, ladder shaped synthetic grid, geotextile layer, and geocell.

3. The structure according to claim 1, wherein the at least one secondary reinforcement member comprises at least one of: synthetic strip, metal strip, metal bar, sheet shaped metal grid, ladder shaped metal grid, synthetic strip, sheet shaped synthetic grid, ladder shaped synthetic grid, geocell, and geotextile layer.

4. The structure according to claim 1, wherein the facing comprises prefabricated elements in which the at least one main reinforcement member is partly embedded.

5. The structure according to claim 4, wherein the prefabricated elements are made of concrete and the at least one main reinforcement member comprises a flexible synthetic reinforcement member having at least one part casted into the concrete of one of the prefabricated elements.

6. The structure according to claim 5, wherein the casted part of the flexible synthetic reinforcement member follows a loop within said one of the prefabricated elements, so that said flexible synthetic reinforcement member has two sections projecting into the first reinforced zone of the fill.

7. The structure according to claim 6, wherein the loop is arranged in said one of the prefabricated elements so that the two sections of said flexible synthetic reinforcement member emerge from the facing into the fill at vertically offset positions.

8. The structure according to claim 6, wherein the loop is arranged in said one of the prefabricated elements so that the two sections of said flexible synthetic reinforcement member emerge at different angles from the facing into the fill in substantially the same horizontal plane.

9. The structure according to claim 1, wherein the facing comprises wire mesh panels to which a soil reinforcement is connected as main reinforcement member.

10. The structure according to claim 1, wherein the at least one secondary reinforcement member is arranged along a zigzag path in the second reinforced zone.

11. A method for building a reinforced soil structure, comprising the steps of:

positioning a facing along a front face of the structure delimiting a volume to be filled;

placing at least one main reinforcement member in a first reinforced zone of said volume, wherein the at least one main reinforcement member is connected to the facing and extends through the first reinforced zone;

placing at least one secondary reinforcement member not permanently connected to the facing in a second reinforced zone of said volume, said first and second zones having a part in common, wherein the at least one secondary reinforcement member is installed up to a distance substantially shorter than the at least one main reinforcement member with respect to the front face, wherein the stiffness of the at least one secondary reinforcement member is greater than the stiffness of the at least one main reinforcement member, and wherein contact is avoided between the at least one main reinforcement member and the at least one secondary reinforcement member in the common part; and introducing fill material into said volume and compacting the fill material.

12. The method according to claim 11, further comprising the step of determining independently an optimal configuration and density of a plurality of the at least one main reinforcement member in said first reinforced zone and an optimal configuration and density of a plurality of the at least one secondary member in said second reinforced zone.

13. The method according to claim 11, further comprising the step of connecting at least some of the at least one secondary reinforcement member to the facing by means of temporary attachments designed to break in the step of introducing and compacting the fill material.

* * * * *